US011585081B2

(12) United States Patent
Beck, III

(10) Patent No.: US 11,585,081 B2
(45) Date of Patent: Feb. 21, 2023

(54) BORDER SECURITY BARRIER

(71) Applicant: A.H. Beck Foundation Co., Inc., Converse, TX (US)

(72) Inventor: August Henry Beck, III, San Antonio, TX (US)

(73) Assignee: A.H. Beck Foundation Co., Converse, TX (US)

( * ) Notice: Subject to any disclaimer, the term of this patent is extended or adjusted under 35 U.S.C. 154(b) by 0 days.

(21) Appl. No.: 17/145,806

(22) Filed: Jan. 11, 2021

(65) Prior Publication Data

US 2021/0156134 A1 May 27, 2021

Related U.S. Application Data

(63) Continuation of application No. 16/695,621, filed on Nov. 26, 2019, now Pat. No. 10,889,977.

(51) Int. Cl.

| | |
|---|---|
| ***E04B 1/04*** | (2006.01) |
| ***E02D 5/28*** | (2006.01) |
| ***E02D 5/30*** | (2006.01) |
| ***E04H 17/16*** | (2006.01) |
| ***E04H 17/14*** | (2006.01) |

(52) U.S. Cl.

CPC ..... *E04B 1/04* (2013.01); *E02D 5/28* (2013.01); *E02D 5/30* (2013.01); *E04H 17/1404* (2013.01); *E04H 17/16* (2013.01); *E02D 2200/16* (2013.01); *E04B 2103/02* (2013.01)

(58) Field of Classification Search

CPC ..... E04B 1/04; E04B 2103/02; E02D 5/28; E02D 5/30; E02D 2200/16; E04H 17/14; E04H 17/16; E04H 17/163; E04H 17/168; E04H 17/1404

USPC ..... 52/414, 319, 299, 293.1, 292, 155; 405/285

See application file for complete search history.

(56) References Cited

U.S. PATENT DOCUMENTS

| | | | | | |
|---|---|---|---|---|---|
| 207,476 | A * | 8/1878 | Baker | A47G 27/0218 | 52/106 |
| 463,549 | A * | 11/1891 | Saxon | E05G 5/02 | 109/6 |
| 1,211,059 | A * | 1/1917 | Blank | E04H 17/063 | 256/1 |
| 2,032,693 | A * | 3/1936 | Fries | E06B 9/01 | 52/456 |
| 2,043,697 | A * | 6/1936 | Deichmann | E04B 2/56 | 52/432 |

(Continued)

*Primary Examiner* — Brent W Herring

(74) *Attorney, Agent, or Firm* — Hasley Scarano, LLP

(57) ABSTRACT

A security barrier is presented for preventing unauthorized persons or vehicles from easily crossing a border. In one preferred embodiment, the security barrier is suitable for installation in a waterway and comprises: (1) a plurality of piles, each pile having a bottom end embedded into the earth and a top end extending vertically upward; (2) an open security grid juxtaposed between and secured by the piles, wherein the grid preferably has a bottom end that extends downward below the surface between the piles toward the earth; (3) at least one rigid wall panel also juxtaposed between and secured by the piles on top of the open security grid, thereby forming a security barrier that allows water, air, aquatic life, and birds to pass through the barrier, but restricts the movement of humans and vehicles across the barrier.

10 Claims, 6 Drawing Sheets

(56) References Cited

U.S. PATENT DOCUMENTS 2,064,334 A * 12/1936 Bayley ..... E06B 9/01 52/204.51
2,351,856 A * 6/1944 Henderson ..... E04B 1/215 52/603
2,578,556 A * 12/1951 Greenhow ..... G08B 15/00 109/42
2,898,638 A * 8/1959 Druckhamer ..... E04F 17/06 52/107
3,279,135 A * 10/1966 Jacobsen ..... E04B 1/043 52/584.1
4,019,301 A * 4/1977 Fox ..... E02D 5/60 52/834
4,252,767 A * 2/1981 Piazza ..... B32B 15/02 264/256
4,290,246 A * 9/1981 Hilsey ..... E02D 27/02 52/125.3
4,673,166 A * 6/1987 MacDougall ..... E04H 17/02 256/11
5,007,200 A * 4/1991 Londono ..... E06B 9/01 49/141
5,524,405 A * 6/1996 Byrd ..... E04C 2/06 256/19
5,537,797 A * 7/1996 Harkenrider ..... E04G 11/10 52/745.13
5,609,002 A * 3/1997 Fernandez ..... E06B 9/01 52/507
5,987,827 A * 11/1999 Lord ..... E04B 1/3505 52/294
6,199,831 B1 * 3/2001 Patrick ..... A01K 3/00 256/11
6,371,699 B1 * 4/2002 Weinreb ..... E02D 29/0233 405/262
7,255,312 B2 * 8/2007 Melic ..... E04G 21/3233 248/125.1
8,020,836 B2 * 9/2011 Bishop ..... E02B 3/06 256/13
8,820,722 B2 * 9/2014 Reinert, Sr. ..... E04H 12/2215 256/65.14
9,163,418 B2 * 10/2015 Ditta ..... E04G 21/3204
9,234,349 B1 * 1/2016 Daiber ..... E04B 2/34
9,988,823 B1 * 6/2018 Fisher ..... E04G 19/003
10,422,156 B1 * 9/2019 Morrow ..... E04H 17/168
10,427,916 B1 * 10/2019 Fisher ..... B66F 9/065
10,633,812 B1 * 4/2020 Fisher ..... E06B 11/02
10,633,887 B1 * 4/2020 Fisher ..... B66C 23/18
10,654,689 B2 * 5/2020 Fisher ..... B66C 1/24
10,683,656 B1 * 6/2020 Van Doren ..... E02D 27/32
10,889,977 B1 * 1/2021 Beck, III ..... E04H 17/16
11,268,293 B2 * 3/2022 Neusch ..... E04H 17/22
11,391,032 B1 * 7/2022 Van Doren ..... E04C 2/30
2008/0095585 A1 * 4/2008 La ..... E02D 29/0283 405/285
2008/0273927 A1 * 11/2008 Knuckey ..... E01F 13/12 405/232
2009/0001335 A1 * 1/2009 Wilson ..... E01F 13/12 256/13.1
2010/0059728 A1 * 3/2010 Bishop ..... E02B 3/06 256/24
2010/0314596 A1 * 12/2010 Thomas ..... E04H 17/16 256/19
2011/0062402 A1 * 3/2011 Neusch ..... E01F 13/12 256/13.1
2012/0049142 A1 * 3/2012 Lill ..... E01F 15/043 256/13.1
2014/0191174 A1 * 7/2014 Ditta ..... E04G 21/3204 256/31
2014/0369753 A1 * 12/2014 Poff ..... E02D 29/06 405/15
2017/0022699 A1 * 1/2017 Lim ..... E04C 5/0604
2018/0283041 A1 * 10/2018 Markham ..... E01F 13/02
2018/0347227 A1 * 12/2018 Neusch ..... E04H 17/1439
2019/0032339 A1 * 1/2019 Matturro ..... E04H 15/008
2021/0156134 A1 * 5/2021 Beck, III ..... E04H 17/16

* cited by examiner

BORDER SECURITY BARRIER

CROSS REFERENCE TO RELATED APPLICATIONS

This application claims priority to U.S. Utility application Ser. No. 16/695,621 ("the '621 Application") filed Nov. 26, 2019. The '621 Application is hereby incorporated by reference in its entirety for all purposes, including but not limited to all portions describing the security barrier, the present inventions and the embodiments disclosed, those portions describing border security barriers in general as background and for use with specific embodiments of the present invention, and those portions describing other aspects of manufacturing and testing of security barriers that may relate to the present invention.

STATEMENTS REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to a security barrier. More particularly, the present invention relates to a security barrier system to prevent human egress across a specified border. Even more particularly, the present invention relates to a security barrier that is suitable for installation in waterways.

2. Description of the Related Art

Walls, barriers, fences and the like have an extremely long history in the field of border security. In border security, various devices and systems must be employed to successfully establish a safe and protected border between various countries and/or between other entities. In order to establish this border according to the prior art, various fencing and other barrier systems are employed in an attempt to prevent unauthorized vehicles and persons from penetrating the border. Such border security has become a top priority of the United States.

In particular, the United States-Mexico border has been a particular focus as of late with concerns of cross-border drug traffic, human trafficking, illegal entry, and as a potential access points for terrorist entry. In March 2017, the United States Customs and Border Patrol issued a request for proposal to design and build of several prototype wall structures in the vicinity of the United States border with Mexico that would meet requirements for aesthetics, anti-climbing, and resistance to tampering or damage. One commonality of all the proposed prototypes offered in response was a design limited to implementing these border walls on land.

Given that over 60 percent of the United States-Mexico border is defined by the Rio Grande River, in fact the entire 1200+ mile Texas Mexico border, land-based border security walls create several particular problems. Many of the arguments made against building and installing a border security wall between the United States and Mexico are directed to problems inherent in these land-based wall systems. For example, the passage of the 2006 Secure Fence Act which authorized building a significant amount of security barriers along the United States southern border gave the government the right to annex private land on which to build the security barriers and provide room for access and patrol roads along the barriers. The result was that many private land owners saw their property taken for and/or divided by a security barrier. The land south of the security barriers became a no man's land owned by but difficult to access for the United States and/or it citizens. These issues were particularly problematic along the Texas-Mexico border where access to the Rio Grande River could be lost to property owners that used the water for cattle, hunting, enjoyment, etc. Additionally, the no man's land south of the border created a perfect staging area for those wanting to illegally cross to set up to climb over, tunnel under, or sabotage the security barrier. Finally, these land-based systems were criticized as causing environmental damage through blocking wildlife migration, separating habitat, obstructing drainage, etc.

It would be desirable to be able to create a border security system that would eliminate the negative side effect of the prior art border security techniques, but effectively restrict unauthorized persons and/or vehicles from crossing the border.

BRIEF SUMMARY OF THE INVENTION

The present invention is security barrier for preventing unauthorized persons or vehicles from easily crossing a border. In one preferred embodiment, the security barrier is suitable for installation in a waterway and comprises: (1) a plurality of piles, each pile having a bottom end embedded into the earth and a top end extending vertically upward; (2) an open security grid (as defined below) juxtaposed between and secured by the piles, wherein the grid preferably has a bottom end that extends downward below the surface between the piles toward the earth; (3) at least one rigid wall panel also juxtaposed between and secured by the piles on top of the open security grid, thereby forming a security barrier that allows water, air, aquatic life, and birds to pass through the barrier, but restricts the movement of humans and vehicles across the barrier. The security barrier of this preferred embodiment would preferably be installed such that the barrier is installed in a waterway, for example in a direction generally parallel with the flow of a river. In one embodiment of security barrier, the open security grid is pre-cast into a rigid wall panel with a portion of the rigid wall panel extending above and below the open security grid. This embodiment is particularly suited for land-based security barrier installations.

Additional advantages of the invention are set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

A better understanding of the present invention can be obtained when the following detailed description of the disclosed embodiments is considered in conjunction with the following drawings in which.

DETAILED DESCRIPTION OF THE INVENTION

The present invention is security barrier for preventing unauthorized persons or vehicles from easily crossing a border. In one preferred embodiment, the security harder is suitable for installation in a waterway and comprises: (1) a plurality of piles, each pile having a bottom end embedded into the earth and a top end extending vertically upward; (2) an open security grid (as defined below) juxtaposed between and secured by the piles, wherein the grid preferably has a bottom end that extends downward below the surface between the piles toward the earth; (3) at least one rigid wall panel also juxtaposed between and secured by the piles on top of the open security grid, thereby forming a security barrier that allows water, air, aquatic life, and birds to pass through the barrier, but restricts the movement of humans and vehicles across the barrier. The security barrier of this preferred embodiment would preferably be built such that the harder is installed in a waterway, for example in a direction generally parallel with the flow of a river. In one embodiment of security barrier, the open security grid is pre-cast into a rigid wall panel with a portion of the rigid wall panel extending above and below the open security grid. This embodiment is particularly suited for land-based security barrier installations.

Figure 1:
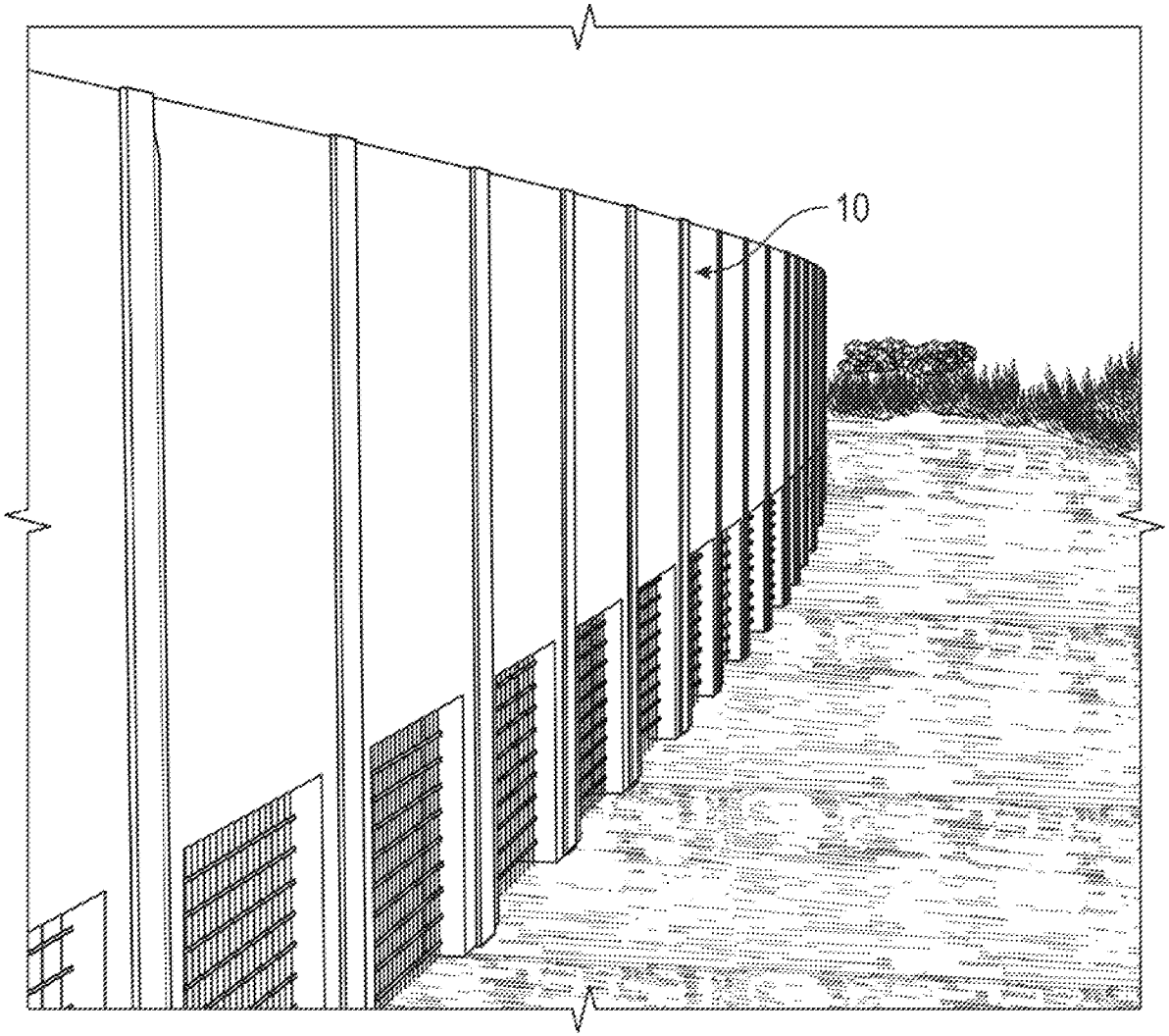
FIG. 1 is a three-dimensional rendering of an embodiment of the security barrier shown in middle of a river.
Figure 2:
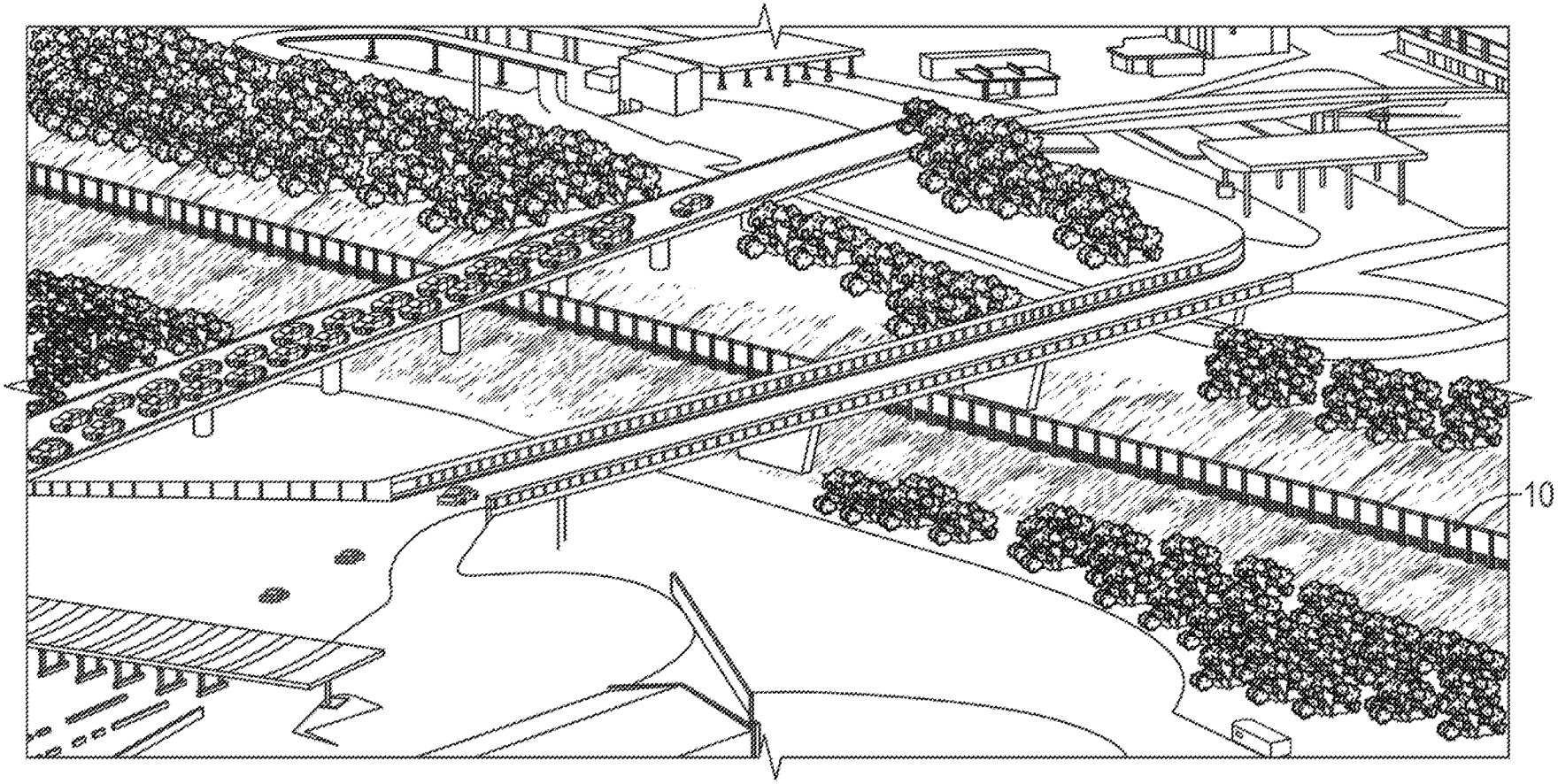
FIG. 2 is an overhead rendering of an embodiment of the security barrier shown running through the river at a United States border crossing area.
Figure 3:
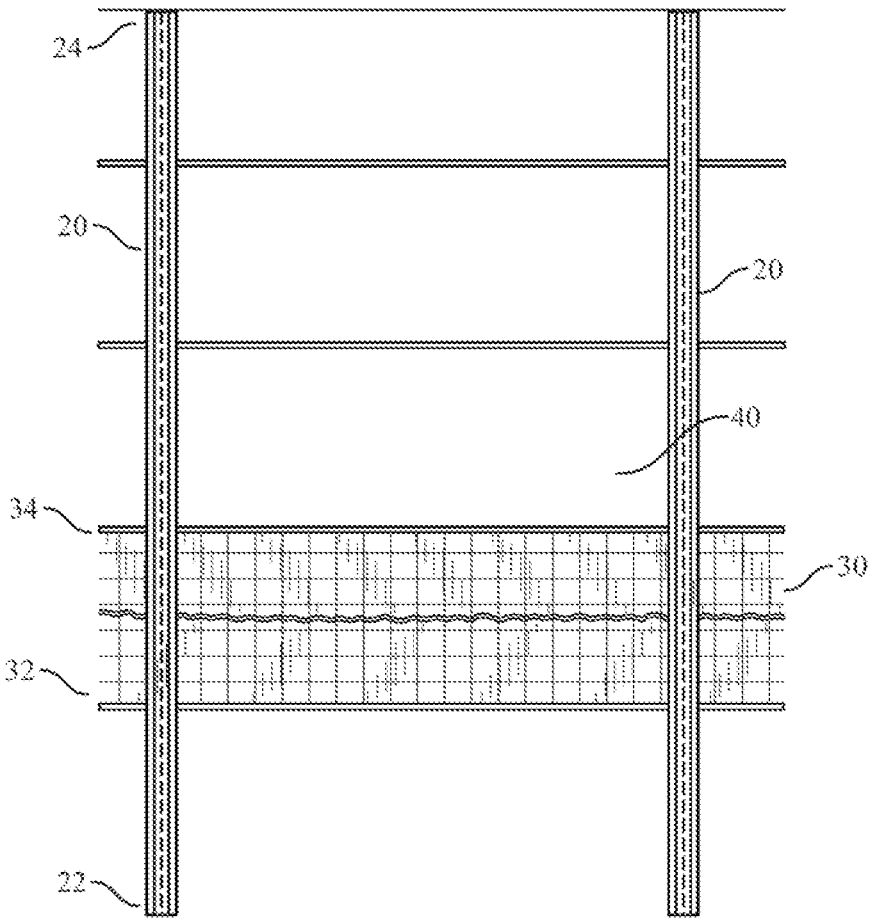
FIG. 3 is a frontal view of an embodiment of the security barrier suitable for use in a waterway.

As shown in FIGS. 1 and 2, an embodiment of the security barrier 10 can be installed in a waterway. As shown in FIG. 3, the security barrier 10 includes a plurality of piles 20 having a bottom end 22 and a top end 24. Piles 20 are preferably steel H-piles, but could comprise steel pipe piles, precast concrete piles of various cross section including circular H configurations, and in some cases, cast in place concrete piles. Instead of a traditional pile, a cast in place drilled shaft could be installed and utilized as pile 20 with either a precast concrete column or cast in place column or steel column attached to the drilled shaft. In one embodiment, a continuous footing would be cast to serve as a foundation on the river bed floor and column and grid would be attached. As a person of skill in the art will now recognize the thickness and characteristics of the piles 20 can vary depending upon the variability of the waterway level and flows, wind conditions, etc. By way of example, a preferred embodiment of pile 20 would be a 12" steel H-pile.

Pile 20 is installed in a generally vertical manner with bottom end 22 embedded into the earth and the top end 24 extending generally vertically upward. As will now be recognized by a person of skill in the art in designing the specifics of a security barrier, soil borings would typically be taken along the length of the trace of the wall. Geotechnical engineers would then evaluate the borings and make recommendations to structural engineers regarding soils capacities for lateral, end bearing, skin friction, etc. The structural engineer would then design the specific dimension of the security barrier by calculating the loads and using the soil values to determine how deep to place the piles 20. Therefore, the actual depth position for the bottom end 22 of pile 20 would be determined by soil values and wall loadings. As will now be recognized, in the security barrier 10 built in a river, the main loadings that determine the loads will likely be wind, debris and flood water loads. Following typical rules of thumb, about 40% to 50% of the pile 20 would be embedded in the riverbed. For example, for a security barrier 10 with a height of 30 foot above the normal pool in 10 feet of water would be embedded about 27 to 40 feet into the ground.

The pile 20 can be installed in a number of ways which a person of ordinary skill in the art will now understand. For example, pile 20 can be driven into the ground, for example with a pile driver, or alternatively drilled into the ground. A hole for the bottom end 22 of pile 20 could also be drilled or pre-drilled for installation of the pile 20. In some embodiments, a bottom shoe (not shown) could be utilized or pile 20 could comprise a pointed tip. As will now be recognized by a person of skill in the art, soil conditions and economics generally determine which type of pile 20 and what type of tip to utilize, if necessary.

In a preferred embodiment, piles 20 are installed on about 20 feet centers, however, depending upon the conditions, other distances between centers could also be utilized. For example, the piles 20 could be placed with about 6 feet and up to about 45 feet between each pile 20. As will now be recognized by a person of skill in the art, closer the centers on piles 20 increases the cost of the security barrier 10. When increasing the distance between the centers, the per section shipping, lining and handling cost may increase. Wall loadings and/or soil conditions are also considerations in determining center distance. Two piles 20 are needed for a single section of the security barrier 10. One additional pile 20 is needed for each additional section of security barrier 10.

As will now be recognized by a person of ordinary skill in the art, the length of the piles 20 between the top end 24 and the bottom end 20 can vary with the particular installation. Preferred embodiments of the security barrier have piles 20 with a length such that the top end 24 of the pile 20 extends about 30 feet above the normal level of the waterway. As a person of skill in the art will now recognize the total length of the pile can vary depending upon the variability of the waterway level and flows, the capabilities of potential intruders, wind conditions, etc. The height of the security barrier 10 will generally be ruled by economics and location of high traffic of human attempts to cross using the general principle of the higher the better. On land, 30 feet high walls are generally considered a good deterrence for climbing because a 30-foot fall is usually a death fall and 30 feet is difficult to climb. It is assumed that a similar height above the water would likewise deter potential climbers.

Once two piles 20 are installed, an open security grid 30 is inserted between the two piles 20. As used herein, the term open security grid means a grid (with horizontal, members, and/or diagonal members), a series of bars (with horizontal, vertical, or diagonal members) having openings that allow flow of water and/or air, and allow visual inspection on the opposite side of the security barrier, but which are sized to restrict humans or vehicles from passing through the barrier. The open security grid 30 is preferably preformed into a panel, or alternatively the grid 30 can be field cut or spliced as needed. In preferred embodiments, the open security grid 30 comprises a steel grid made of steel with a ¾" round bar or a ¾" deformed rebar. The bar diameter should be as small a diameter as possible to minimize flow restriction but large enough to deter cutting or sawing through to make an opening. Preferably, the grid openings should be as large as possible so as not to deter flow and aquatic passage but small enough so that a small person cannot pass through. By way of an example, the grid 30 could be about 8 inches by 8 inches, or possible even as large as 12 inches by 12 inches. As will now be recognized by a person of skill in the art, the size and spacing of the grid 30 can be adapted to the particular needs of the installation. Alternatively, the open security grid 30 may comprise a series of bars. In a preferred embodiment, the bars comprise a square cross section, such as square tubular bars, but other shapes or configurations could be utilized depending upon economics, security demands, and designer preference. The gap between bars can be very narrow, 2 inches for example, upward to 8 inches gaps; however, the narrower the gap and wider the bar the more water flow restriction and aquatic life passage restriction. In preferred embodiments of a open security grid 30 having crossing members, i.e., horizontal and vertical, the members are preferably connected at the point of crossing. Such a connection could be welded or fused or secured together by other means as would be known to a person of skill in the art.

Preferably, the members of the open security grid 30 are comprised of steel, however other metals and materials of construction which are commonly known may also be suitable. In preferred embodiments the metals are galvanized or coated with an anti-corrosion material such as epoxy.

When installed, the open security grid 30 is juxtaposed between two piles 20 with a bottom portion 32 extending downwardly in the direction of the riverbed and an upper portion 34 extending above the water. In shallower waters, bottom portion 32 of the open security grid is preferably at least partially embedded into the riverbed. For deeper waters, the bottom portion 32 only needs to extend downward into the river deep enough to discourage potential swimmers, for example 25 feet below the normal surface.

As will be now recognized by a person of skill in the art, the dimensions of the open security grid 30 can be varied depending upon the needs and the conditions for the security barrier 10. For example, a preferred embodiment includes an open security grid 30 comprising a preformed panel of about 8 feet by 20 feet. The width of the open security grid 30 is necessarily sized in coordination with the distance between the piles 20. For example, a security barrier 10 with piles on 20 foot centers would utilize and open security panel having a nominal with of 20 feet. The height of the open security grid 30 is determined by the depth required below the ground, the depth of the waterway, and/or the preferred height above the water. In preferred embodiments, the top of the grid 30 would extend about 6 feet above the normal water level, or alternatively as high as the 100 year flood plain. As will be recognized by those of skill in the art, the higher grid 30 could make climbing the wall easier and needs to be balanced with the viewing height.

Once the open security grid 30 is installed between the piles 20, a rigid wall panel 40 is inserted between the piles 20 and above the open security grid 30. As shown in FIG. 3, there can be several rigid wall panels 40 installed horizontally and utilized in a single section of security barrier 10, or alternatively a large single rigid wall panel 40 can be utilized by installing vertically. As will now be recognized by one of skill in the art, the dimensions of the rigid wall panel 40 will vary on the installation depending upon the installation conditions, engineering requirements, building codes, etc. In a preferred embodiment, the rigid wall panel 40 will have a width of about 20 feet, a height of about 8 feet, and a thickness of about 4 inches. An advantage of this size panel 40 is that can be easily handled, erected, and shipped. For example, up to five panels of these dimensions could be shipped on a single truck without requiring permitting. While the dimensions of the rigid wall panels 40 can be varied, preferred ranges include width of 18 to 21 feet, by 6 to 8.5 feet in height, by 4 to 8 inches in thickness. As will be recognized by persons of skill in the art, the width and height of the rigid wall panel 40 should be coordinated with the height and placement of the piles 20. Precasting the rigid wall panels 40 speeds up the construction process and allows for centralization of raw materials and fabrication machinery. As a person of skill in the art would now recognize, the precast panels could utilize rebar, post tensioned cables, prestressed tendons, or some combination.

Each open security grid 30 and rigid wall panel 40 are preferably secured to the piles 20. In some embodiments, the open grid 30 and the rigid wall panel 40 can be secured within the H-piles with a wedge forced in between the grid or panel edges and the inside of the H-pile. Alternatively, to gain composite integrity and strength, the grid 30 or panels 40 will be fixed to the piles 20. For example, the grids 30 could be welded to steel H-piles. Steel plate inserts could be utilized on the corners or sides of the rigid wall panels 40, for example through precasting, to facilitate welding or bolting to the piles 20. In some embodiments, a clip or similar mechanism that secures the grid 30 or panel 40 in place. For example, a structural clip (not shown) comprising a short piece of steel angle, i.e., a six inch angle, could be bolted to the rigid wall panel and either bolted to a concrete pile or welded to a steel pile. If a square precast concrete pile is utilized, short pieces of steel channel could be bolted to the pile 20. The panels 40 could then be slid down in and be guided by the channels as set in place. The panels 40 then could then be bolted to the channels, or in the case of a cast in anchor plate, welded to the channels. This technique could also be utilized on a steel pipe pile or a round concrete pile or a many sided (i.e. hexagonal or octagonal) concrete piles. In other embodiments, fear example those utilizing a pipe pile, channels or clips, welded or attached on the sides of the pipe can be utilized to slide and captivate the grid and panels. While in preferred embodiments, the rigid wall panels 40 and open security grids 30 are secured to the piles 20, the invention includes embodiments in which the rigid wall panels 40 and open security grids 30 are simply captivated by the piles, such as having edges within the open portions inside an H-pile.

In some embodiments of the security barrier 10, a steel cable (for example, a ½" up to about 1" diameter cable) can be strung along the top of the security barrier 10 and positively connect to the top of each pile 20 to add additional composite strength. In a preferred embodiment, one cable would be run connecting a number of piles 20 (for example, a 1000-foot cable), and a second cable of similar length added beginning at about the half way point of the first cable (i.e. at 500 feet) and extended down the security barrier (for example, another 1000 feet). These strengthening cables could then be added in an overlapping manner down the length of the security barrier 10.

The particular embodiment of FIG. 3 when constructed from three horizontal rigid wall panels 40 and an open security grid 30 extending six feet over the normal water line would provide a 30 foot security barrier in the middle of the water way. As will now be recognized by those of ordinary skill in the art, the modular construction of the security barrier 10 reduces construction cost, set up and building time, and eases maintenance and repairs.

Preferred embodiments further comprise additional means for inhibiting climbers attached to the upper portion of the security barrier 10. Persons of skill in the art will recognize that such anti-climbing toppers can include spikes, rotating elements, broken glass set in mortar, tubular attachments, or other devices such as are readily available. Additionally, the security barrier 10 can be equipped with security cameras for remote surveillance.

As shown in FIGS. 1 and 2, the security barrier 10 can be installed in a water way, such as the Rio Grande River. Preferably, the security barrier 10 is installed in a manner parallel to the river banks and water flow. As can be seen, the security barrier 10 is not required to be completely linear but can be adjusted to follow the meanderings of a river or other water way. The security barrier 10 could be built directly on an international border line or removed a short distance to avoid conflicting claims or changes in the flow of the river. By adding additional sections of barrier, there is no limit to the length of the security barrier 10 and it can be implemented in a manner to secure the entire Texas Rio Grande Border with Mexico. As will now be appreciated, a lengthy security barrier 10 placed in a waterway provides an insurmountable barrier. There is no solid staging area from which to attempt to scale the barrier absent utilization of barges or other larges scale equipment. Tunneling risk is substantially eliminated as such a tunnel would require a tunnel extending under the entire waterway.

As will now be apparent to those of skill in the art, the embodiment of FIGS. 1 and 2 eliminate problems of conventional border security barriers which require use of eminent domain to take private land on which to build the barrier. Rather, property owners not only retain their land, but their access to the water way, while at the same time benefit from the increased security provided by this embodiment of the security barrier. Additionally, the security barrier 10 as shown in FIG. 1 and 2 is both aesthetically pleasing and environmentally friendly. Because the security barrier 10 is built in the river and includes the open security grid 30, the view from the raised riverbank is only partially obscured and there is an up close view to the other side of the river. Further, the security barrier 10 installed in the water way can mitigate bank erosion, particularly along river bends during flooding. As the security barrier 10 is in the water, the natural ecosystem is not disturbed. Wildlife can continue to access the waterway and aquatic life can pass through the submerged open security grid 30.

Figure 4:
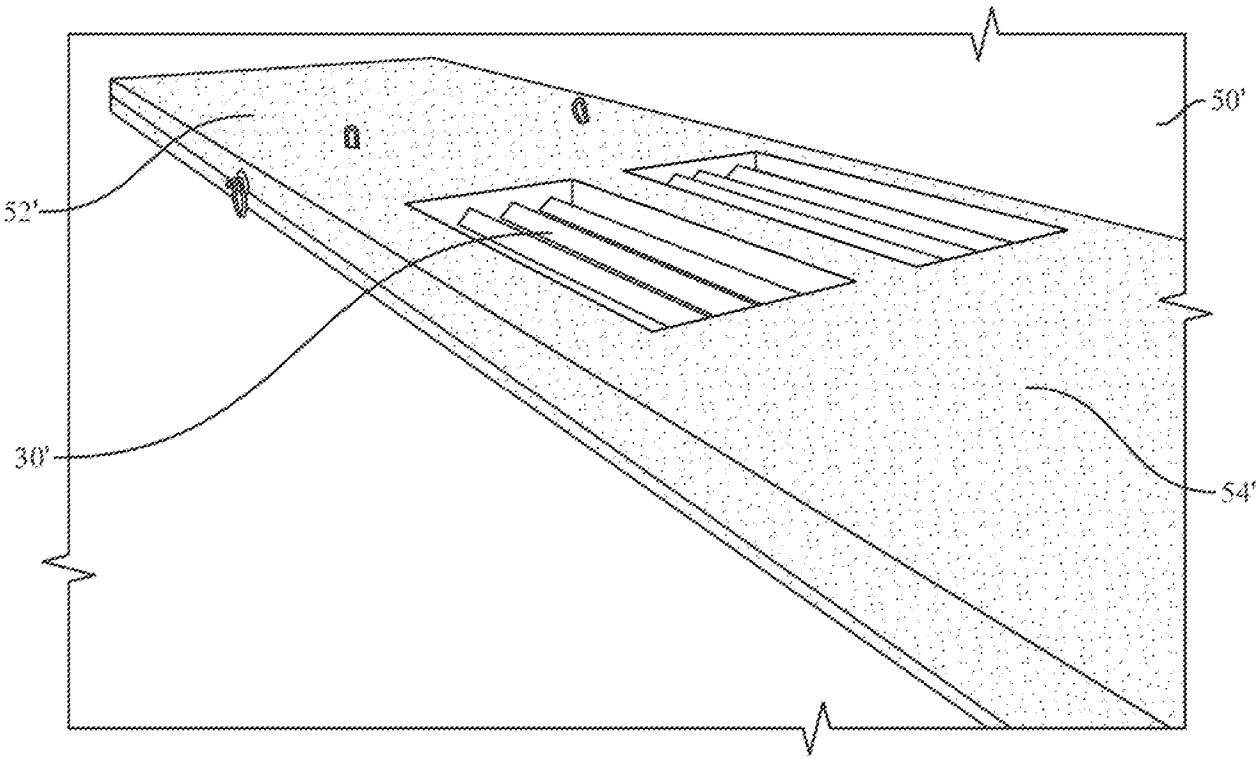
FIG. 4 is a pre-cast panel of a second embodiment type of security barrier.
Figure 5:
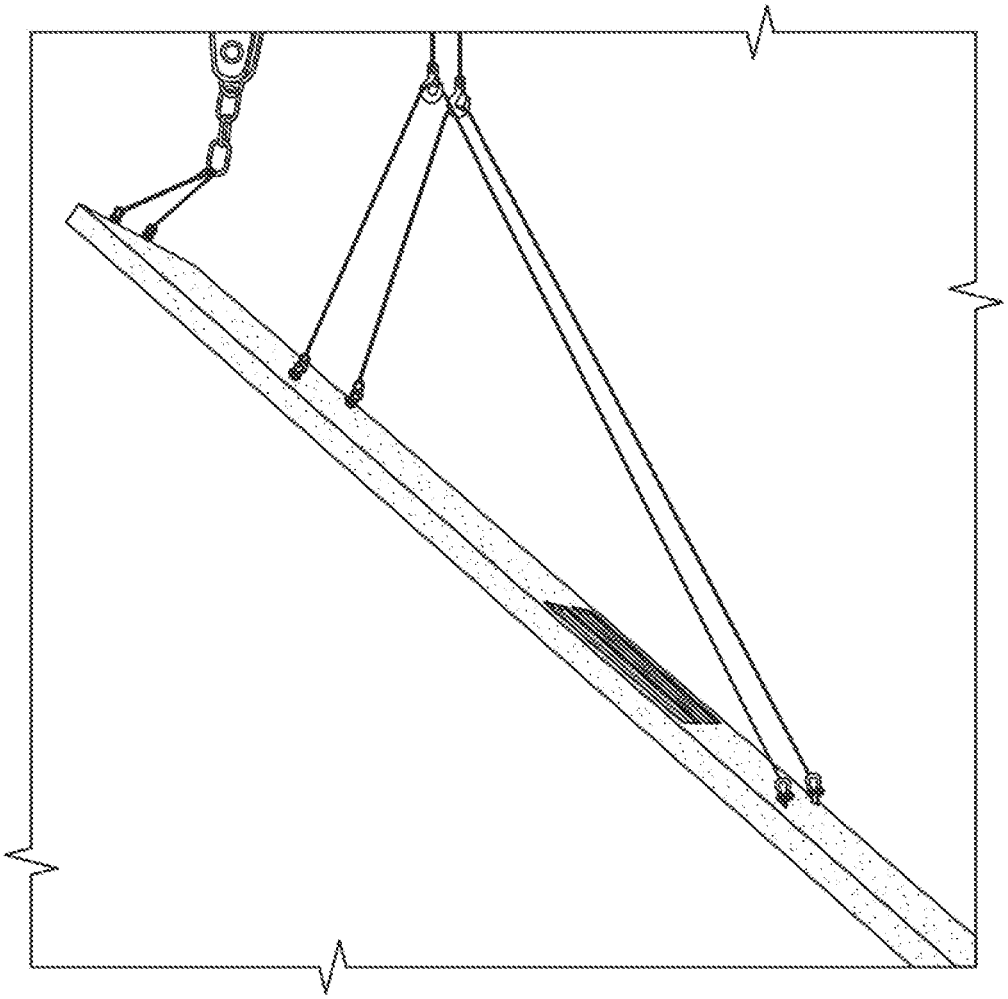
FIG. 5 is a depiction of the panel of FIG. 4 being raised for a land-based installation.
Figure 6:
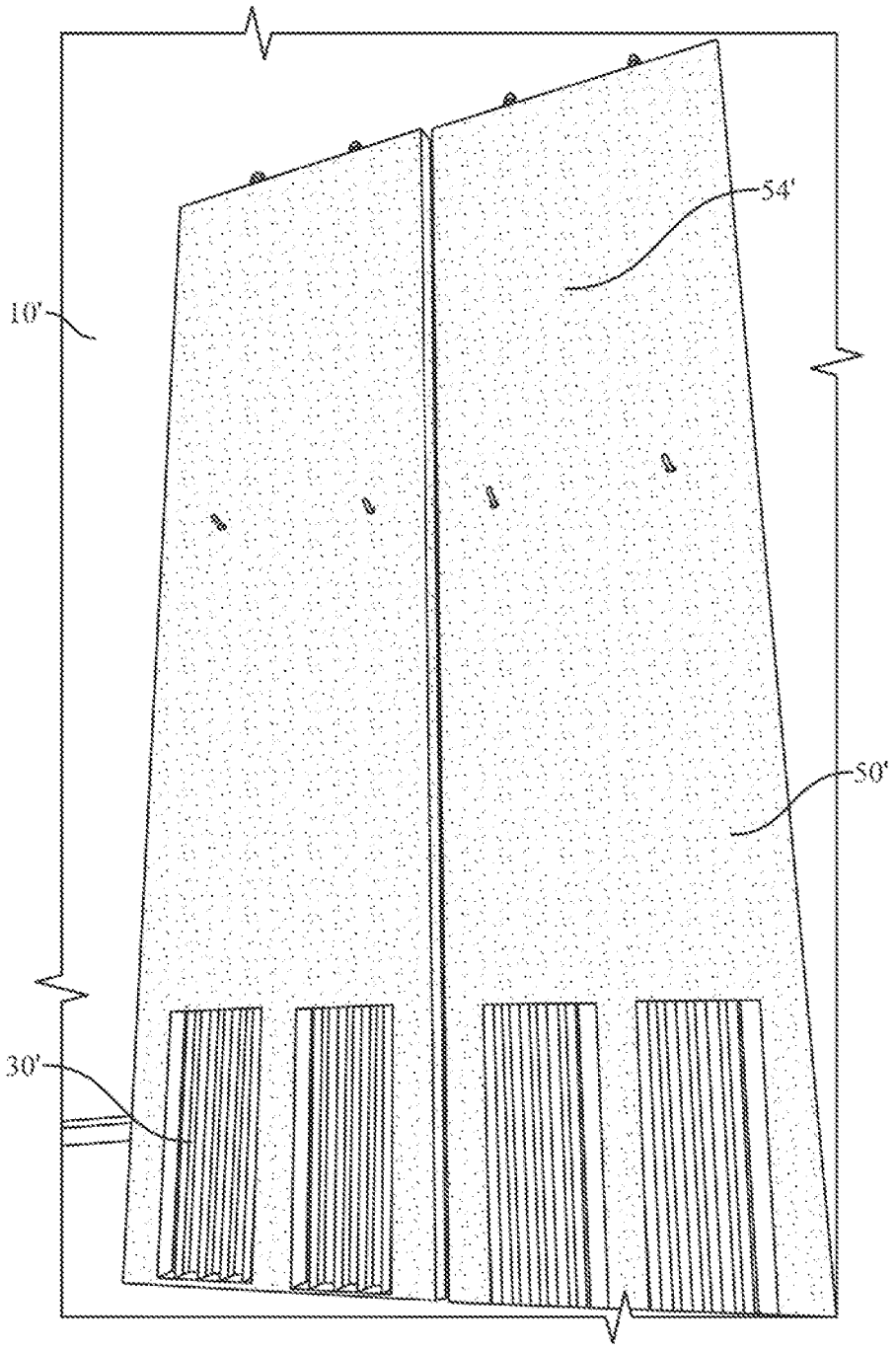
FIG. 6 is an embodiment of a security barrier with a land-based installation.

While the embodiment of FIG. 3 is designed for water way, with minor modifications that will now be readily apparent to a person of skill in the art, this embodiment can also be utilized on land. Alternatively, FIGS. 4, 5, and 6 show a different embodiment that is particularly suited for a land-based security barrier. In this embodiment, an entire section of the barrier can be pre-manufactured. The pre-manufactured section comprises an open security grid 30' (as previously defined), an upper rigid wall panel portion 54', and a lower rigid wall panel portion 52'. As shown in FIGS. 4, 5, and 6, the open security grid 30' can be a series of vertical steel members. When this embodiment is utilized as a land-based security barrier 10', the members need to be sized to prevent easy cutting to breach the barrier 10'. Preferably, such slats would be about 4" with square cross section. The entire section 50' is preferably between about 7 and 10 feet in width, between about 30 and 45 feet in height, and between about 6 and 10 inches thick. The particular embodiments shown in FIGS. 4, 5 and 6 are about 6 inches thick but could be thinner or thicker to satisfy construction codes for concrete cover and engineering load requirements. By way of example, in the embodiment of FIGS. 4, 5 and 6, the open security grid 30' has a height of about 6 feet, the upper rigid wall panel portion 54' has a height of about 24 feet, and the lower rigid wall panel portion 52' has a height of about 15 feet. As will now be recognized by one of skin in the art, the height dimension and the width dimension can be varied to fit the needs of a particular situation, ground conditions, threat risks, etc.

As shown in FIGS. 5 and 6, the premanufactured sections can be installed by lifting the entire section 50' into a vertical position, lowering the lower rigid wall portion 52' into a preferably pre-excavated trench, and back filling the earth into the trench once the section 50' has been placed. Alternatively, the trench can be filled with gravel or concrete. Preferably, the trench depth is deep enough to discourage tunneling, for example about 15 feet deep. As show in FIG. 6, the section 50' is positioned such that the open security grid 30' is proximate to the ground level allowing for visual inspection of the hind on the opposite side of the security barrier 10' and natural drainage. As will now be recognized, the embodiment of FIGS. 4, 5 and 6 is preferably utilized as a land-based security barrier 10' that can be easily and quickly installed on a cost effective basis. While this embodiment is designed for land-based installation, a person of skill in the art will recognize that under certain circumstances this embodiment could also be utilized as a security barrier 10' in a waterway.

While the terms used herein are believed to be well-understood by one of ordinary skill in the art, definitions are set forth to facilitate explanation of certain of the presently-disclosed subject matter. Following long-standing patent law convention, the terms "a", "an", and "the" refer to one or more when used in this application, including the claims. Thus, for example, reference to "a window" includes a plurality of such windows, and so forth.

Unless otherwise indicated, all numbers expressing quantities of elements, dimensions such as width and area, and so forth used in the specification and claims are to be understood as being modified in all instances by the term "about". Accordingly, unless indicated to the contrary, the numerical parameters set forth in this specification and claims are approximations that can vary depending upon the desired properties sought to be obtained by the presently-disclosed subject matter.

As used herein, the term "about," when referring to a value or to an amount of a dimension, area, percentage, etc., is meant to encompass variations of in some embodiments plus or minus 20%, in some embodiments plus or minus 10%, in some embodiments plus or minus 5%, in some embodiments plus or minus 1%, in some embodiments plus or minus 0.5%, and in some embodiments plus or minus 0.1% from the specified amount, as such variations are appropriate to perform the disclosed methods or employ the disclosed compositions.

The term "comprising", which is synonymous with "including" "containing" or "characterized by" is inclusive or open-ended and does not exclude additional, unrecited elements or method steps. "Comprising" is a term of art used in claim language which means that the named elements are essential, but other elements can be added and still form a construct within the scope of the claim.

As used herein, the phrase "consisting of" excludes any element, step, or ingredient not specified in the claim. When the phrase "consists of" appears in a clause of the body of a claim, rather than immediately following the preamble, it limits only the element set forth in that clause; other elements are not excluded from the claim as a whole.

As used herein, the phrase "consisting essentially of" limits the scope of a claim to the specified materials or steps, plus those that do not materially affect the basic and novel characteristic(s) of the claimed subject matter. With respect to the terms "comprising", "consisting of", and "consisting essentially of", where one of these three terms is used herein, the presently disclosed and claimed subject matter can include the use of either of the other two terms.

As used herein, the term "and/or" when used in the context of a listing of entities, refers to the entities being present singly or in combination. Thus, for example, the phrase "A, S, C, and/or O" includes A, S, C, and O individually, but also includes any and all combinations and subcombinations of A, S, C, and O.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. The foregoing disclosure and description are illustrative and explanatory thereof, and various changes in the details of the illustrated apparatus and construction and method of operation may be made without departing from the spirit in scope of the invention which is described by the following claims.

I claim:

1. A border security barrier of modular construction comprising:

an open security grid, the grid having a bottom end, a top end, and a pair of sides, and a rigid concrete wall panel comprising an upper rigid wall panel portion having a top end, a lower rigid wall panel portion having a bottom end, and two side rigid wall panel portions, said upper, lower, and side rigid wall panel portions being cast together to form said rigid concrete wall panel;

wherein said open security grid is precast and embedded into the rigid concrete wall panel between said upper rigid wall panel portion, two side rigid wall panel portions, and lower rigid wall panel portion forming a single barrier wall section with the open security grid being intermediate to the upper rigid wall panel portion, two side rigid wall panel portions, and lower rigid wall panel portion, wherein at least the bottom end of the lower rigid wall panel portion is embedded into an earth surface and the rigid concrete wall panel extends generally vertically upward from the earth surface, and wherein the open security grid comprises steel slats having a square cross sections with four inch thicknesses.

2. The border security barrier of claim 1, wherein said open security grid comprises a series of vertical steel slats.

3. The border security barrier of claim 1, wherein said open security grid comprises a series of horizontal steel slats.

4. The border security barrier of claim 1, wherein said open security grid comprises a grid of horizontal and vertical steel slats.

5. The border security barrier of claim 1 wherein the barrier wall section has a width between 7 and 10 feet.

6. The border security barrier of claim 1, wherein the entire lower rigid wall panel and the bottom end of the open security grid are embedded below the earth surface.

7. The border security barrier of claim 1, wherein the open security grid has a height of about six feet.

8. The border security barrier of claim 1 wherein the barrier wall section has height between 30 and 4 feet.

9. The border security barrier of claim 1 wherein the rigid concrete wall panel has a thickness of about 4 inches.

10. The border security barrier of claim 1 wherein the rigid concrete wall panel has dimensions of between about 18 to 21 feet by about 6 to 8.5 feet..

* * * * *